US005374791A

United States Patent [19]

LeMarchand

[11] Patent Number: 5,374,791

[45] Date of Patent: Dec. 20, 1994

[54] AUTOMATIC STOP DEVICE FOR THE ELECTRIC DRIVE OF A DOOR, SHUTTER, BLIND OR THE LIKE

[75] Inventor: Marc Philippe LeMarchand, Marignier, France

[73] Assignee: Somfy, Cluses, France

[21] Appl. No.: 16,691

[22] Filed: Feb. 11, 1993

[30] Foreign Application Priority Data

Feb. 28, 1992 [FR] France ..... 92 02389

[51] Int. Cl.[5] ..... H01H 3/16

[52] U.S. Cl. ..... 200/47; 200/38 R; 192/139

[58] Field of Search ..... 200/19 R, 21, 30 R, 200/28, 333, 35 R, 38 R, 47, 329, 337, 573; 192/116.5, 138, 139

[56] References Cited

U.S. PATENT DOCUMENTS

| | | | |
|---|---|---|---|
| 2,519,907 | 8/1950 | Hodgson | 200/47 |
| 3,937,910 | 2/1976 | Fukami | 200/35 R |
| 4,171,473 | 10/1979 | Hugin | 200/47 |
| 4,307,269 | 12/1981 | Rotthaus | 200/47 X |
| 4,314,119 | 2/1982 | Fillion | 200/47 |
| 4,322,589 | 3/1982 | Pommat et al. | 200/30 R |
| 4,411,348 | 10/1983 | Fillion | 192/139 |
| 4,523,062 | 6/1985 | Mahon | 200/35 R |

FOREIGN PATENT DOCUMENTS

| | | |
|---|---|---|
| 2554158 | 5/1985 | France . |
| 8503645 | 3/1985 | Germany . |

*Primary Examiner*—Glenn T. Barrett

*Attorney, Agent, or Firm*—Laff, Whitesel, Conte & Saret, Ltd.

[57] ABSTRACT

A compact automatic stop device for two mechanisms for counting revolutions which consist of coaxial counting wheels (10, 10') each associated with a notched cam (14, 14') interacts with a cutoff finger (24, 24') securely fastened to a common cutoff lever (20, 20'), so that when the notches (19) are aligned, the cutoff lever actuates a switch (26, 26'). A set-to-zero lever (29, 29') makes it possible to reset the counting wheels to zero by acting via hammers (33') on core cams (18'). The counting wheels, the cutoff levers and the set-to-zero levers of each counting mechanism are pivoted in a common cradle (5, 5') articulated with respect to a fixed casing (1) having profiled parts (36, 37, 36', 37') which are intended to interact with the cutoff levers and the set-to-zero levers during the displacement of the cradles.

3 Claims, 2 Drawing Sheets

FIG. 1
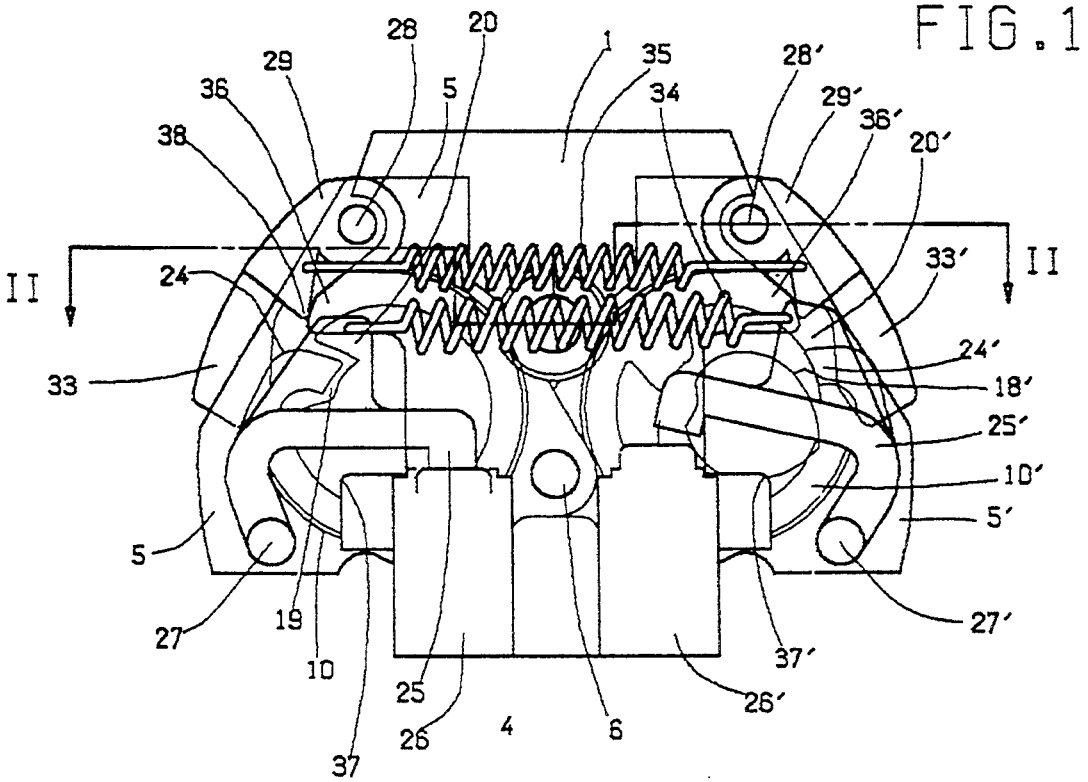
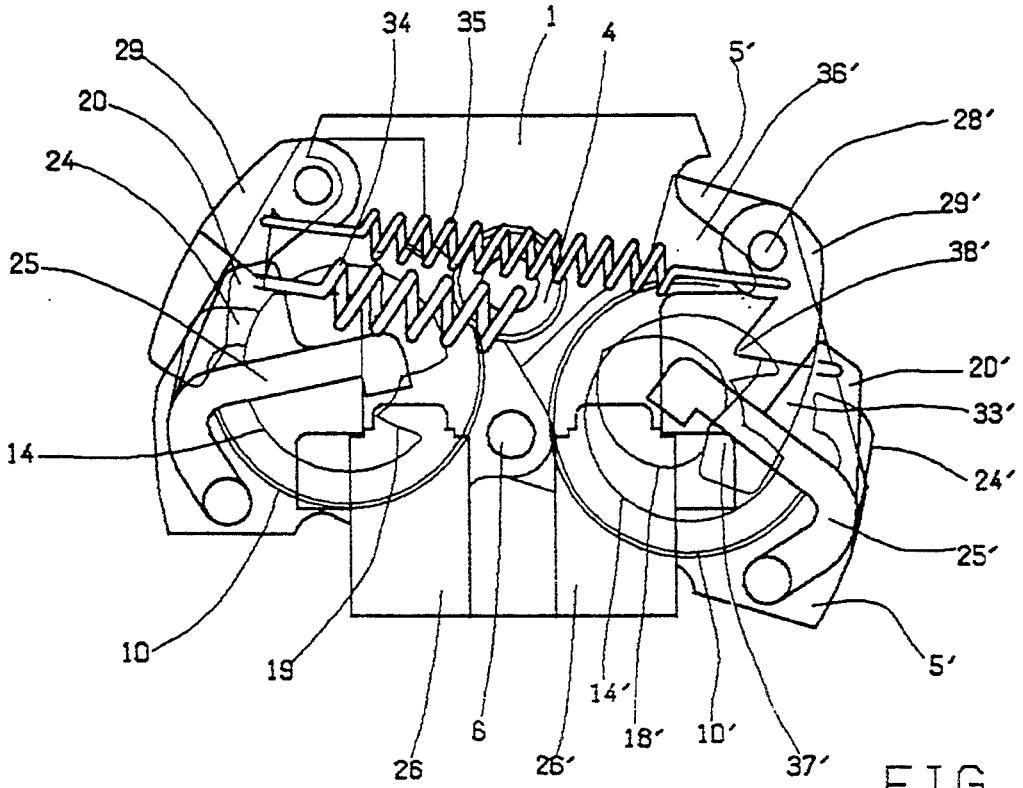
FIG. 3

AUTOMATIC STOP DEVICE FOR THE ELECTRIC DRIVE OF A DOOR, SHUTTER, BLIND OR THE LIKE

FIELD OF THE INVENTION

The subject of the present invention is an automatic stop device for the electric drive of a door, shutter, blind or the like, comprising two revolution-counting mechanisms, consisting of coaxial wheels driven at different speeds and each associated with a notched cam interacting with a cutoff finger securely fastened to a common cutoff lever stressed by a spring holding the cutoff fingers bearing against the notched wheels so that when the notches are aligned, the cutoff fingers penetrate the notches and a switch is actuated by the cutoff lever, the device further comprising two mechanisms for setting the counting mechanisms to zero and consisting essentially of means for disengaging the counting wheels and of a set-to-zero lever fitted with hammers acting on core cams respectively associated with each of the wheels of the counting mechanism.

PRIOR ART

Such a device is known from the patent FR 2,455,695 with the difference, however, that this prior device only comprises a single counting mechanism. In this device, the differential movement of the counting wheels is obtained by kinematic connection produced by means of an intermittently engaging return element pivoted on a spindle parallel to the counting wheels. This type of engagement allows a large number of revolutions to be counted with high accuracy, but exhibits drawbacks when it involves producing a device providing two automatic stop points as is generally necessary in the case of a blind or a rolling shutter. Indeed, in order to drive two counting mechanisms, it is necessary to have two independent returns which must be pivoted either on two separate spindles themselves separate from the spindle supporting the input of the movement on the first wheel, or on the same spindle but with the returns then arranged in the extension of one another. Furthermore, an intermittent engagement necessitates accompanying arrangements such as the presence of a spring for holding in position during the non-engaging period. All this is the source of considerable bulk, complications, and therefore excess cost. Furthermore, in the prior device the means for disengaging and setting the counting wheels to zero are relatively complicated and the counting wheels are mounted on a cradle pivoting on the casing whilst the cut-off lever is mounted directly on the casing. This extends the chain of tolerances and requires high accuracy to be respected on the elementary components of the device.

The U.S. Pat. No. 4,171,473 also discloses a counting mechanism comprising three counting wheels arranged coaxially and in which each counting wheel engages with a separate gear, the gears being arranged on the same spindle to which they are rotationally securely fastened. The differential movement of the counting wheels is obtained by virtue of a separate ratio between each wheel and gear pair. Each wheel comprises sliding zones and notches interacting with rollers having the function of cutoff levers. This device is complex and requires one gear spindle per counting mechanism, one gear per counting wheel and a kinematic connection between each counting spindle and the movement input spindle. Furthermore, it is neither easy nor very quick to reset the counter because it is necessary, after having brought the door, rolling shutter or the like into the desired stop position, to act axially on a knurled wheel in order to disengage the gear spindle from the input spindle, then rotationally to drive it by hand until the counting wheels of the counting mechanism assume the position allowing all the rollers of the cutoff mechanism simultaneously to penetrate the notches of the counting wheels. If the counting wheels are in any position, the operation may take a great deal of time.

SUMMARY OF THE INVENTION

The object of the invention is to produce an automatic stop device with two stop points which is simpler and less bulky than prior devices.

The automatic stop device according to the invention is defined in that the counting wheels, the cutoff levers and the set-to-zero levers belonging to each of the counting mechanisms are pivoted in a common cradle articulated, with respect to a fixed casing carrying the input gear and the switches, about a spindle parallel to the axis of the counting wheels, so that each of these cradles may pivot from a first position, in which the counting wheels are engaged with the gear, to a second position in which the counting wheels are moved away from said gear, and the fixed casing has profiled parts intended to interact with the cutoff levers and the set-to-zero levers during the displacement of the cradles, so as to set the core cams to zero and to close the corresponding switch when the cradles are brought into their second position, springs being provided to keep the counting wheels engaged, the cutoff fingers bearing on the notched cams, and the set-to-zero levers bearing on the corresponding profiled parts of the fixed casing.

Each cradle, with its counting wheels, its cutoff lever and its set-to-zero lever, constitutes a relatively simple unit whose accuracy can easily be ensured. The disengagement control transmission and set-to-zero mechanism of the prior art is eliminated in favor of simple profiled shapes of the casing acting as fixed cams controlling the movement of the set-to-zero lever and of the cutoff lever during pivoting of the cradle.

The counting wheels are preferably driven by a common input gear with two different sets of teeth. In each counting mechanism some of the wheels are engaged with one of the sets of teeth and the others with the other set of teeth.

According to a preferred embodiment of the invention, the springs are reduced in number to two for the whole device, one of these springs connecting the cutoff levers of the two counting mechanisms together and simultaneously keeping the counting wheels engaged, and the other spring connecting the set-to-zero levers of the two counting mechanisms together. Comparatively, a device according to French patent 2,455,695 comprises three springs per counting mechanism, without including the spring for keeping the intermittent engagement return element in position.

Since the counting mechanisms may be arranged on either side of the input spindle, preferably symmetrically, the axial bulk of a device with two stop points is the same as that of a device with a single stop point.

BRIEF DESCRIPTION OF THE DRAWING

The appended drawing represents, by way of example, an embodiment of the device according to the invention.

FIG. 1 is an axial view of the device in the engaged position of the two counting mechanisms.

FIG. 3 is a view analogous to that of FIG. 1 in which one of the cradles is represented in the disengaged and set-to-zero position.

DESCRIPTION OF THE PREFERRED EMBODIMENT

Figure 2:
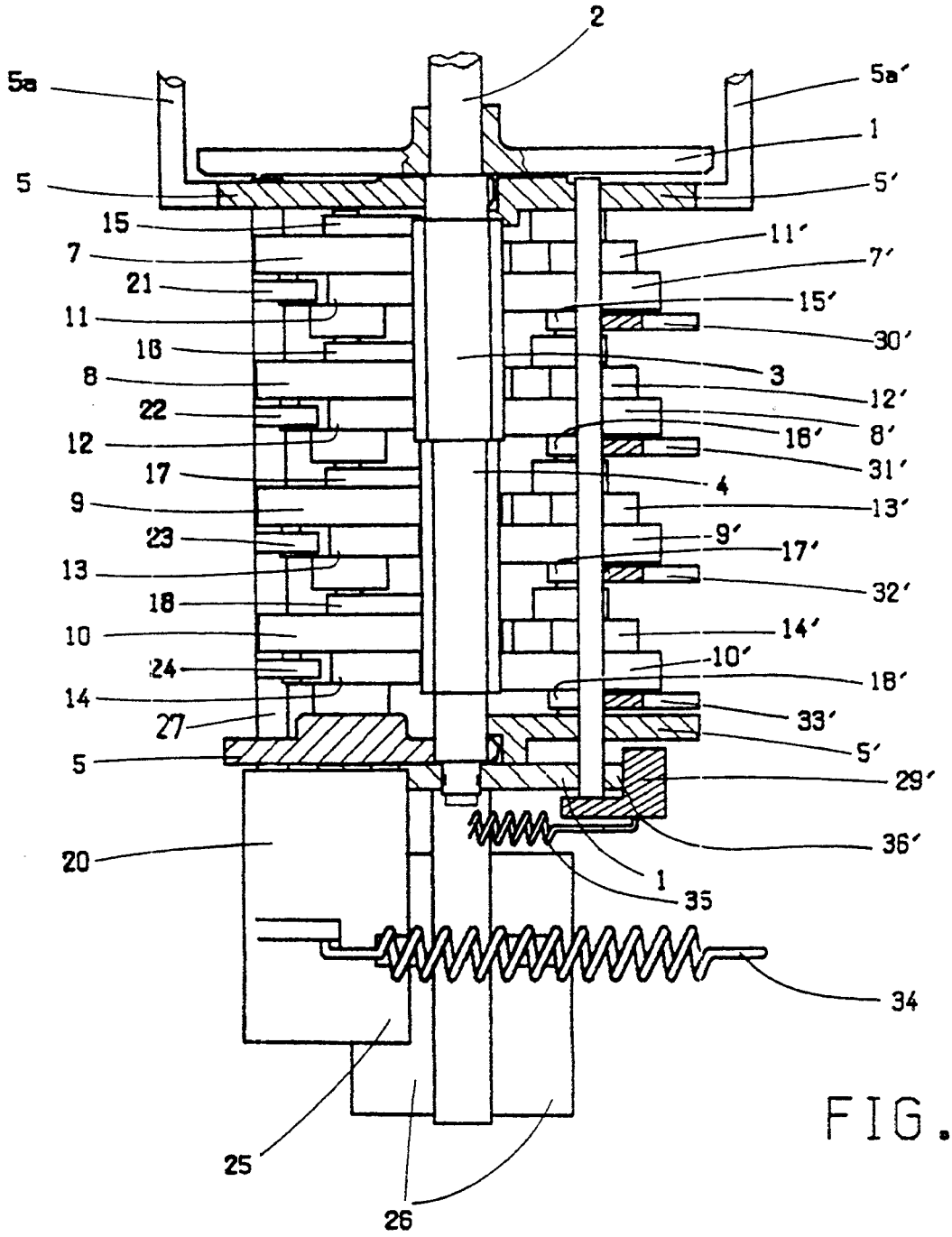
FIG. 2 is a sectional view along II—II of FIG. 1, the part to the left of the axis of symmetry being represented without the set-to-zero lever, whilst the part to the right of the axis is represented without the cutoff lever.

The device represented comprises a casing 1 in which there is pivoted a shaft 2 carrying a long gear having, over its length, two different sets of teeth 3 and 4. The shaft 2 is intended to be driven by the drive motor of the door, blind, rolling shutter or the like, more precisely by the output of the reduction gear combined with this motor. On the casing 1 there are furthermore mounted, symmetric with the shaft 2, two identical cradles 5 and 5' mounted pivotably on the casing 1 about a common spindle 6 situated in the plane of symmetry of the device and they are provided with an arm 5*a*, 5'*a* respectively, via which they may be tilted manually by means of push rods which are not shown.

Mounted coaxially in the cradle 5 there are four counting wheels 7, 8, 9, 10 free to rotate on a common spindle. The wheels 7 and 8 have a different number of teeth as do the wheels 9 and 10. Each of the counting wheels is flanked on one side by a notched cam consisting of a smooth wheel coaxial with the counting wheel and whose circumference is interrupted by a notch 19 (FIG. 1), and on the other side by a core cam forming a block with the counting wheel. The counting wheels 7, 8, 9, 10 are thus respectively combined with a notched cam 11, 12, 13, 14 and with a core cam 15, 16, 17, 18.

Furthermore, a cutoff lever 20 is pivoted in the cradle 5 about an axis 27 parallel to the axis 2. This cutoff lever 20 is provided with four fingers 21, 22, 23, 24 rigidly connected to the cutoff lever and interacting with the notched cams 11, 12, 13, 14 respectively. The cutoff lever 20 is furthermore fitted, at one of its ends, with a bent arm 25 rigidly connected to the cutoff lever and intended to actuate a first switch 26 fixed to an extension of the casing 1.

Furthermore, in the cradle 5 there is pivoted, about an axis 28 parallel to the shaft 2, a set-to-zero lever 29 fitted with four arms constituting hammers intended to actuate each of the core cams 15 to 18 respectively. In FIG. 2, the set-to-zero lever and its hammers have not been shown, in order to see the cutoff lever clearly. In FIG. 1, only one of the hammers 33 can be seen.

The second counting mechanism mounted in the cradle 5' is produced in a manner identical to the first counting mechanism and comprises the same elements which have been denoted by the same references as those of the first counting mechanism accompanied by the sign ' in order to avoid repetition of the description. The set-to-zero lever 29' of this second counting mechanism can be seen in plan view in the right-hand part of FIG. 2. The four set-to-zero hammers 30', 31', 32', 33' can be made out. The cutoff lever 20' of the second mechanism has not been shown in FIG. 2. It will be noted that the symmetry of the two counting mechanisms is not total, the position of the notched cams and of the core cams being reversed with respect to the position of these elements in the first counting mechanism, the component parts of a counting wheel, of a notched cam and of a core cam being the same for the two counting mechanisms. The cutoff fingers and the set-to-zero hammers are consequently situated offset with relation to the same elements of the first counting mechanism.

The bent arm 25' of the cutoff lever of the second counting mechanism interacts with a second switch 26' fixed like the switch 26.

The cutoff levers 20 and 20' are connected to one another via a first tension spring 34 which has the simultaneous effect of keeping the cutoff fingers bearing on the notched cams and keeping the counting wheels of the two mechanisms engaged with the sets of teeth 3 and 4 of the input gear. The set-to-zero levers 29 and 29' of the two mechanisms are also connected by a second tension spring 35 which provides the force necessary for actuating the core cams.

The casing 1 has, on each side, profiled parts 36 and 37, 36' and 37' respectively fulfilling the role of cams for controlling the movement of the set-to-zero levers 29 and 29' and the cutoff levers 20 and 20'.

In the left-hand part of FIG. 1, the shape of the profiled part 36 can clearly be seen, in the form of a lateral projection having a ramp at its end on which a tip 38 constituting the end of the set-to-zero lever 29 bears.

While the set-to-zero levers 29 and 29' bear on the profiled parts 36 and 36' when the counting wheels are engaged with the input gear, the profiled parts 37 and 37' only momentarily come into contact with the bent arms 25 and 25' of the cutoff levers during setting to zero, as will be described later with respect to FIG. 3.

In FIGS. 1 and 2, the cutoff fingers 21 through 24 are represented engaged in the notches of the notched cams 11 through 14, which signifies that the first counting mechanism is in a stop position, the bent arm 25 of the cutoff lever acting on the switch 26 under the effect of the spring 34. In contrast, the cutoff fingers of the second counting mechanism are not engaged in the notches of the notched cams 11' through 14'. The second mechanism is therefore in an intermediate position in which the bent arm 25' is held away from the switch 26'.

The device is used with a motor having two windings allowing the motor to be rotated in both directions of rotation. The switch 26 is connected in series with one of the windings of the motor and a switch for controlling a first direction of rotation, whilst the other switch 26' is connected in series with the second winding of the motor and a switch for controlling the second direction of rotation.

A vertical pressure on the arm 5'*a* of the cradle 5 has the effect of tilting the latter about its spindle 6 as shown in FIG. 3. The counting wheels are disengaged from the sets of teeth 3 and 4 of the input gear and, during this tilting, the tip 38' of the set-to-zero lever 29' leaves the profiled part 36' allowing the set-to-zero lever 29' to pivot in the direction of the core cams. Under the effect of the spring 35, the set-to-zero hammers 30' through 33' act on each of the core cams 15' through 18' and align the notches of the notched cams 11' through 14'. The bent arm 25' of the cutoff lever comes into abutment against the profiled part 37' of the casing and it is moved away from the switch 26'. When the pressure on the actuating arm 5'*a* of the cradle 5' is then released, the latter returns to its initial position, the set-to-zero and cutoff levers therefore occupying the position represented in the left-hand part of FIG. 1, that is to say with the cutoff fingers in the notches of the notched cams and the switch 26 actuated by the bent arm 25.

The stop points of the device are adjusted as follows:

With the direction-control switch 1 actuated, that is to say closed, the cradle 5 of the first counting mechanism is brought into its disengaged and set-to-zero position corresponding to the position 5' represented in FIG. 3. The first winding of the motor is powered and the controlled member (door, blind or rolling shutter) is driven. When the first desired automatic stop point is reached, the cradle 5 is released and comes to occupy the position represented in FIG. 1. The switch 26 is actuated and the motor is no longer powered.

A similar procedure is followed for adjusting the second automatic stop point by actuating the direction-control switch 2 and by displacing the cradle 5' as represented in FIG. 3. As soon as the second desired stop point is reached, the cradle 5' is released, whose levers come to occupy the same position as that of the cradle 5 of FIG. 1.

During adjustment of the second stop point, the counting wheels of the first counting mechanism have been rotationally driven and the notches of the notched wheels no longer coincide. The levers of the first mechanism occupy the position represented in FIG. 3.

Operation in periods of use will be described starting from the position represented in FIG. 1. In this position, the adjusted device is in its first stop position. The switch 26 is open and action on the first direction-control switch remains without effect. An action on the second direction-control switch, in contrast, has the effect of powering the motor and driving the controlled member until the notches of the notched wheels of the second counting mechanism come into alignment allowing the cutoff lever 20' to tilt and to actuate the switch 26' leading to the motor being stopped in its second stop position.

During this time, the counting wheels of the first counting device have been driven and their notches are no longer aligned, so that at least one of the cutoff fingers bears on the circular part of the corresponding notched wheel and the corresponding switch is not actuated, as represented in FIG. 3.

The device described is, of course, capable of variants. In particular, the number of counting wheels of each counting mechanism may be other than four, but in practice a minimum of three counting wheels must be provided, for example two wheels engaging with the set of teeth 3 and one wheel engaging with the set of teeth 4. Each counting mechanism may comprise, for example, two sets of three wheels interacting respectively with the sets of teeth 3 and 4 or three wheels engaging with one of the sets of teeth and two wheels engaging with the other set of teeth of the input gear. Instead of two springs common to the two mechanisms, springs could be provided belonging to each mechanism.

The device could comprise parallel input gears, one for each counting mechanism.

I claim:

1. An automatic stop device for an electric drive of a door, shutter or blind, said automatic stop device comprising two revolution-counting mechanisms consisting of coaxial wheels (7 through 10, 7' through 10') driven by at least one gear at different speeds and each wheel is associated with a notched cam (11 through 14, 11' through 14') each said notched cam interacting with a cutoff finger (21 through 25, 21' through 24') securely fastened to a common cutoff lever (20, 20'), said cutoff lever stressed by a spring (34) holding the fingers against the notched cams, so that when cam notches (19) and cutoff fingers are aligned, the cutoff fingers penetrate the cam notches and a switch (26, 26') is actuated by the cutoff lever, the device further comprising two mechanisms (29, 29') for setting the counting mechanisms to zero and consisting essentially of means for disengaging the counting wheels and a set-to-zero lever (29, 29') fitted with hammers (33, 30' through 33') acting on core cams (15 through 18, 15' through 18') respectively associated with each of the wheels of the counting mechanism, wherein the counting wheels (7 through 14, 7' through 14'), the cutoff levers (20, 20') and the set-to-zero levers (29, 29') belonging to each of the counting mechanisms are pivoted in a common cradle (5, 5') articulated, with respect to a fixed casing (1) carrying an input gear and the switches, about a spindle (6) parallel to an axis of the counting wheels, so that each of these cradles may pivot from a first position, in which the counting wheels are engaged with the gear (3, 4), to a second position in which the counting wheels are moved away from said gear, and the fixed casing (1) has profiled pans (36, 37, 36', 37') intended to interact with the cutoff levers and the set-to-zero levers during the displacement of the cradles so as to set the core cams to zero and to close a corresponding switch when the cradles are brought into their second position, spring means (34, 35) being provided to keep the counting wheels engaged, the cutoff fingers bearing on the notched cams, and the set-to-zero levers bearing on the corresponding profiled parts of the fixed casing.

2. The automatic stop device as claimed in claim 1, wherein it comprises a long input gear having an axis and two sets of teeth (3, 4) common to the two counting mechanisms arranged on either side of the axis of said input gear, each counting mechanism comprising at least three counting wheels, at least one of said counting wheels engages with one set of teeth of the input gear, and the other counting wheels with the other set of teeth of the input gear.

3. The automatic stop device as claimed in claim 2, wherein said spring means consist of a first tension spring (34) connecting the cutoff levers of the two cradles and of a second tension spring (35) connecting the set-to-zero levers of the two cradles, the counting wheels therefore being kept engaged with the input gear by the first spring.

* * * * *